United States Patent [19]

Franklin

[11] 4,073,328

[45] Feb. 14, 1978

[54] ARROW QUIVER

[76] Inventor: Dwaine R. Franklin, 1845 Arizona Ave., Yuma, Ariz. 85364

[21] Appl. No.: 795,096

[22] Filed: May 9, 1977

[51] Int. Cl.[2] ..... A63B 67/00

[52] U.S. Cl. ..... 150/1.5 R

[58] Field of Search ..... 150/1.5 R, 1.5 B, 1.5 C; 224/1 B; 124/23 A; 211/60 R, 60 G

[56] References Cited

U.S. PATENT DOCUMENTS

| | | | |
|---|---|---|---|
| 1,756,902 | 4/1930 | Boyce | 150/1.5 R |
| 2,722,958 | 11/1955 | King | 150/1.5 R |
| 2,746,658 | 5/1956 | Freid | 124/23 A UX |
| 2,771,620 | 11/1956 | Hoffman | 150/1.5 R |
| 2,881,817 | 4/1959 | Brion | 150/1.5 R |
| 2,905,218 | 9/1959 | Smith | 150/1.5 R |
| 2,908,432 | 10/1959 | Kent | 150/1.5 R X |

*Primary Examiner*—Donald F. Norton
*Attorney, Agent, or Firm*—Drummond, Nelson & Ptak

[57] ABSTRACT

An arrow quiver particularly suited for use by hunters and worn on the back comprises an open, elongated frame with an abutment at its upper end against which the arrow heads are pressed. The arrows are aligned and spaced from one another by a pair of bridges, the lowermost one of which has a number of spaced slots across it, each slot accomodating the shaft of an arrow. The slots are tapered so that they are narrower on the side facing the upper portion of the quiver and are made of resilient material which overlaps the shaft of an arrow pressed into the slot. The shape of the slots facilitates loading of the arrows into the quiver and sliding them upwardly to permit the heads to rest against the abutment. The taper of the slots, however, impedes movement of arrows through the slots downwardly away from the abutment to hold them firmly in place until removal is desired by pivoting the arrows outwardly out of the slots.

10 Claims, 5 Drawing Figures

ARROW QUIVER

BACKGROUND OF THE INVENTION

The use of bows and arrows for hunting game dates back hundreds of years to a time when the bow and arrow was the only effective way of killing game for food. While the basic technique of bow and arrow hunting employed with modern equipment is still the same as early primitive equipment, the modern hunting bow is a far cry from the simple instruments used by the Indians and hunters of medieval and pre-medieval times. Similarly, modern arrows are precision made with shafts which are straight within very close tolerances. Various types of heads and feathers (or Fletchings) then are attached to the shaft to form a balanced entity.

While substantial improvements have been made in the structure of bows and arrows over the years, relatively little progress has been made in the quiver or carrying case used for the arrows. Early quivers simply were open-ended, elongated bags carried on the back or the side of the hunter into which a number of arrows were placed head down. Such quivers, however, do not effectively separate the arrows and make it extremely difficult to stalk game since the arrow shafts may rattle against one another, making noise, which in turn frightens the game. In addition, if such a quiver is used with a modern hunting arrow, the heads of the arrows may become entangled with one another so that an attempt to withdraw an arrow may result in snagging one or more other arrows located in the quiver, spilling them out on the ground when the desired arrow is withdrawn. Once again, the resulting confusion and clatter of the falling arrows very likely will frighten away the game which is being stalked. In addition, the extremely sharp edges of modern hunting arrow heads could result in injury to a person using such arrows with such a quiver if they should become entangled in this manner.

Various solutions have been proposed for spacing or separating hunting arrows in quiver arrangements of different types. Some such arrangements include an attachment placed on the side of the bow and including spaced apart resilient fingers for grasping the shafts of arrows held in place on the bow. This arrangement, however, creates additional weight and imbalance to the bow; and location of the arrows makes a smooth withdrawal of an arrow from the holder and placement of it onto the bow string extremely difficult.

Another type of back-mounted quiver presently available utilizes a spring biased clamping arrangement to press downwardly on the nocks of the arrows to clamp them between a fixed abutment at the head end and the spring loaded abutment at the nock end. Such a quiver, however, is capable of holding only arrows of exactly the same length at any given time and also is difficult to use in the rapid and smooth removal of a single arrow.

A different type of quiver is worn on the side of the hunter and has a pocket or pouch for receiving the arrow heads. Resilient fingers or spacers are located above the pouch for engaging the shafts of the arrows carried in the quiver. This arrangement, however, is cumbersome and again is difficult to use in quickly withdrawing an arrow from the quiver and placing it in position on the bow for use.

It is desirable to provide an arrow quiver for use by hunters which is worn on the back, which is not susceptible to spillage of the arrows when the hunter bends over, which places the arrows in a convenient position for withdrawal and use by the hunter and which further is capable of accomodating and intermixing arrows of different lengths without any modification or adjustments.

SUMMARY OF THE INVENTION

Accordingly, it is an object of this invention to provide an improved arrow quiver.

It is another object of this invention to provide an improved arrow quiver carried on the back of the user.

It is an additional object of this invention to provide an improved arrow quiver capable of accomodating arrows of different lengths without adjustment.

It is a further object of this invention to provide an improved arrow quiver which carries the arrows head up on the back of the user.

It is yet another object of this invention to provide an improved arrow quiver which holds the arrows spaced apart from one another for ready access by the user.

It is still a further object of this invention to provide an improved arrow quiver which is capable of carrying and holding simultaneously arrows of different lengths head up on the back of the user.

In accordance with a preferred embodiment of this invention, an arrow quiver comprises an elongated frame which has an abutment located at one end of it and extending outwardly from the plane of the frame. A bridge is mounted across the frame on the same side as the abutment and includes resilient material having a plurality of spaced slots formed across it. Each of the slots accomodates and grips the shaft of a different arrow, and the slots also are constructed to impede the sliding of an arrow shaft through the slot in a direction away from the abutment located at the end of the frame.

In a more specific embodiment, the slots are in the form of a frustoconical configuration with the small end located nearest the abutment and each having an opening on the side opposite the frame to permit an arrow shaft to be pressed into the slot. The width of the opening is less than the diameter of the frustoconical slot to firmly grip an arrow in the slot.

DETAILED DESCRIPTION

Figure 1:
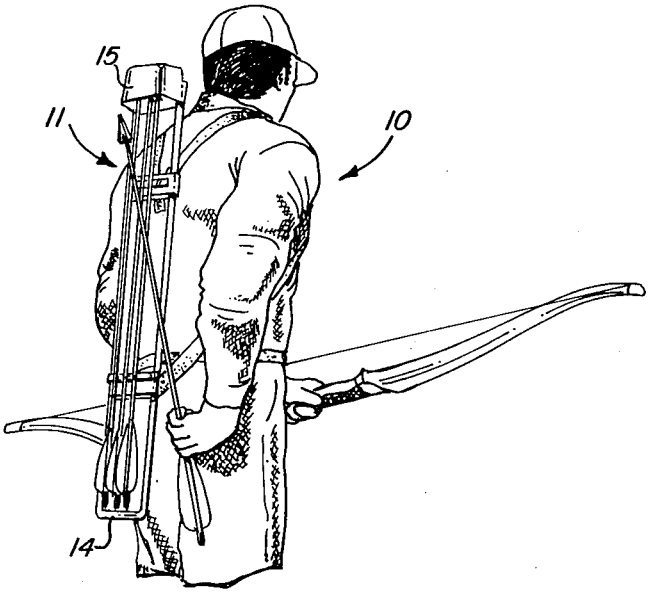
FIG. 1 shows an arrow quiver according to a preferred embodiment of the invention, illustrating the manner in which the quiver is worn and used.

Referring now to the drawing, the same reference numbers are used throughout the different figures to designate the same components. In FIG. 1, a hunter 10 is illustrated wearing on his back an arrow quiver 11 made in accordance with a preferred embodiment of this invention. FIG. 1 illustrates the relative size of the arrow quiver and shows the manner in which it is worn with the heads of the arrows pointed upwardly, so that the user may simply reach behind him with his free hand and grasp the arrow on the shaft near the butt end to permit it to be easily swung into position in a smooth continuous movement to engage the nock in the string of the bow.

Figure 2:
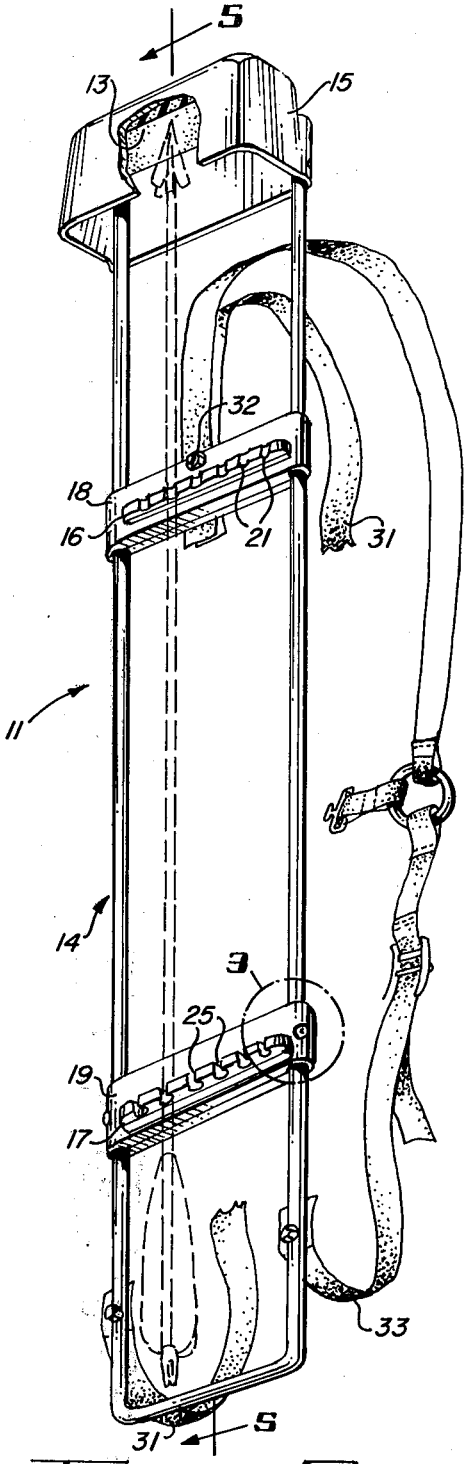
FIG. 2 is a partially cutaway perspective view of the arrow quiver of FIG. 1.

FIG. 2 illustrates the arrow quiver 11 in greater detail. The frame of the quiver is formed of an elongated "U" shaped aluminum tubing, or the like, having a length which is slightly in excess of the length of the longest arrows which are to be used with the quiver. The open ends of the tubular frame 14 are secured to an open cup-shaped protective container or cap 15 which has an abutment 13 extending across its closed end in a plane which is at right angles to the plane formed by the tubular frame 14. The abutment 13 preferably is covered with a resilient pad made of rubber or some other suitable material to hold the points of the arrow heads in position and to protect the points when arrows are being carried in the quiver. The side walls of the cap 15 are attached to the ends of the tubular frame 14 in any suitable manner and extend toward the opposite or closed end of the frame 14 a distance sufficient to enclose the heads of any arrows carried in the quiver.

To separate the heads of the arrows and to prevent their shafts from rattling against one another when the quiver is fully loaded and carried on the back of a hunter, the arrows are spaced apart from one another by a pair of bridges 16 and 17, both of which span the frame 14 and are mounted on support bases 18 and 19, respectively. These bases 18 and 19 also provide structural support and strength for the frame to maintain the spacing of the two legs of the U-shaped tubular member 14 parallel to one another.

The bridge 16 has several equally spaced semicircular slots 21 located in it and these slots have a radius which is selected to be approximately the same as the radius of the shafts of the arrows to be carried in the quiver. The bridge 16 preferably is made of resilient material to prevent any audible sounds from being made when an arrow shaft vibrates or bumps against the bottoms of the slots 21 as the person carrying the quiver moves about.

Figure 3:
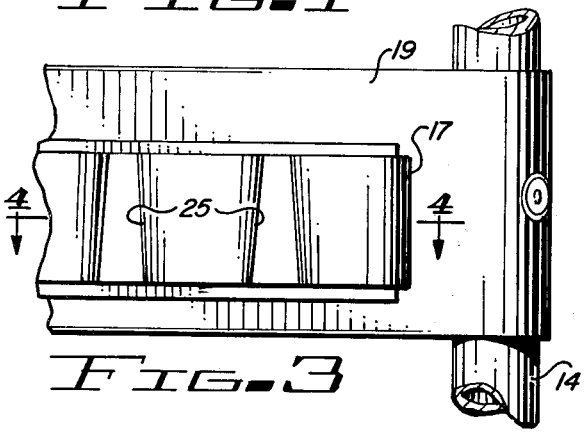
FIGS. 3, 4 and 5 show details of the arrow quiver of FIG. 2.
Figure 4:
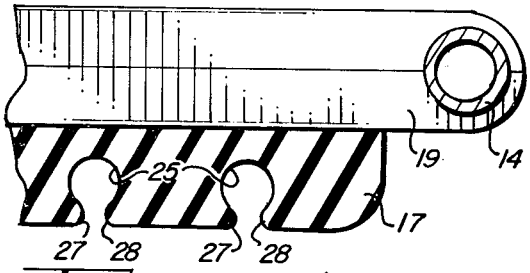

The bridge 17 also is made of resilient material which may be rubber or any suitable rubber-like plastic of various types presently commerically available. This bridge 17 also has a number of equally spaced slots 25 located in it, and these slots are longitudinally aligned with the slots 21 in the bridge 16 to accomodate a like number of arrow shafts in aligned relationship with one another in the manner illustrated by the dotted line configuration of an arrow shown in FIG. 2. The slots 25, however, are not simple semi-circular open slots like the slots 21 in the bridge 16. Instead, the slots 25 are formed as frustoconical sections (shown most clearly in FIG. 3). The narrower ends of each of the slots are on the side of the bridge 17 which is nearest the abutment 13 in the cap 15. In addition, the slits or openings of the slots 25 on the side of the bridge 17 opposite its base, have a width which is less than the diameter of the arrow shafts to be placed in the slots 25. This is shown most clearly in FIG. 4. This narrower opening is formed by a pair of inwardly projecting shoulders 27 and 28 on each of the slots 25, and the nature of the material of which the bridge 17 is formed is such that these shoulders compress and give when an arrow is inserted into a slot 25 or pulled outwardly from the slot. Once an arrow, however, is in place in the slot, the shoulders 27 and 28 overlie the arrow shaft to firmly hold it in position.

Figure 5:
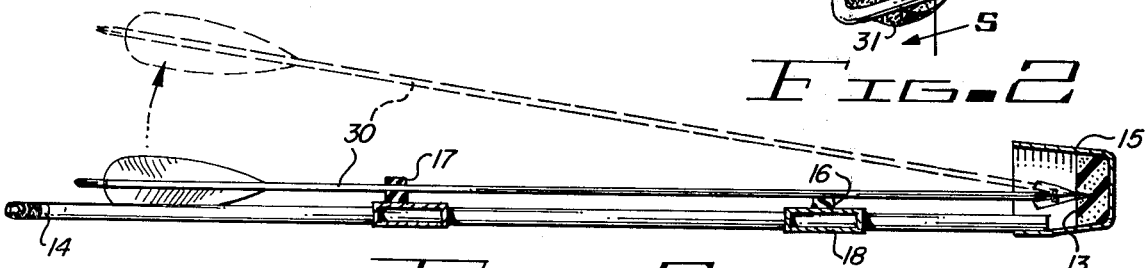

Reference now should be made to FIG. 5 which illustrates the manner in which an arrow is loaded onto the quiver or removed from it. When an arrow 30 is to be loaded onto the quiver, the head of the arrow preferably is placed generally within the enclosed portion of the cap 15 but is not pressed into the abutment 13. The shaft of the arrow at the end nearest the cap 15 then is pressed downwardly into the slot 21 in the bridge member 16 which is to accomodate that particular arrow; and the arrow is rotated counterclockwise, as viewed in FIG. 5, from the dotted line to the solid line position. The shaft of the arrow then is pressed downwardly into the desired slot 25, distorting the shoulders 27 and 28 until the shaft is positioned in the slot, whereupon the shoulders 27 and 28 extend over the arrow shaft somewhat to hold it in place.

The final step then is to slide the shaft of the arrow 30 upwardly (or toward the right as viewed in FIG. 5) until the head of the arrow 30 firmly engages the resilient material forming the abutment 13 in the cap 15. The movement of the arrow shaft through the slot 25 to accomplish this loading is upwardly, as viewed in FIG. 3, which forces the frustoconical slot 25 open and provides relatively little impedance to the movement of the arrow in this direction. Reverse movement of the arrow shaft, however, tends to close the narrow end of the frustoconical slots 25 more tightly together resulting in considerable impedence to such reverse movement of the arrow shaft. Thus, once the arrows 30 are loaded into the quiver 11, they are firmly held in place and will not accidentally fall out of the quiver.

Removal of an arrow is accomplished by placing fingers underneath an arrow 30 on opposite sides of the bridge 17 and pulling upwardly with these fingers while pressing down on the bridge with the thumb to pop the arrow out of the slot 25. By pressing downwardly with the thumb on the bridge 17 while raising the shaft of the arrow 30 with the fingers upwardly or outwardly, as viewed in FIG. 5, the arrow is rotated from the solid line position to the dotted line position shown in FIG. 5. Once this has been accomplished, the arrow 30 may be removed simply by the user sweeping his arm downwardly and forward (as shown in FIG. 1) to swing the arrow into place for use with the bow.

The quiver which has been shown and described above is worn in the most convenient place for the hunter, his back. When the arrows are properly loaded into the quiver, movement of the hunter in any manner he sees fit will not result in spilling or dropping out of any of the arrows from the quiver. They are prevented from clattering together. At all times, the arrows are presented to the hunter in the most convenient position for rapid removal from the quiver and loading onto his bow. This is in contrast to conventional quivers which carry the arrows point down, so that the hunter must relocate the position of the arrow shaft in his hand prior to engaging its nock with the bow string. This is not necessary with the quiver of this invention. The frame member 14 has a length which extends beyond nocks of arrows carried in the quiver, so that the arrows are not accidentally dislodged from the quiver when the hunter moves through underbrush or the like. In addition, this extension of the frame beyond the nocks of the arrows serves to protect the arrows from damage when the quiver is not in use and is being stored.

As shown in FIG. 2, a pair of carrying straps 31 and 33 each are terminated at a mounting point on opposite sides of the frame member 14 near the bottom end of the frame. At the upper end, the straps 31 and 33 are pivotally mounted in a common point by a suitable swivel pin 32 or the like at the center of the brace 18. Various suitable attachment arrangements for the straps 31 and 33 may be used, and the particular arrangement shown is merely for purposes of illustration.

Various modifications and variations of the quiver which has been shown and described will occur to those skilled in the art without departing from the true scope of the invention as defined in the following claims.

I claim:

1. An arrow quiver including in combination:

an elongated frame member having an abutment member located at one end thereof and extending outwardly from the plane of said frame member; and a bridge member mounted across said frame member on the same side as said abutment member, said bridge member being formed of resilient material and having a plurality of tapered slots therein, each of such slots for accommodating and gripping the shaft of an arrow and the slots each being tapered with the narrow end thereof on the side of the bridge nearest said abutment member for impeding sliding of an arrow shaft through such slot in a direction away from said abutment member.

2. The combination according to claim 1 wherein each of said slots have a frustoconical configuration.

3. The combination according to claim 1 wherein said bridge member is attached on one side to said frame member and the slots therein have a generally circular cross section in a plane perpendicular to said frame member, each of said slots having an opening on the side of said bridge member opposite the side attached to said frame member, the width of the opening in each of said slots being less than the diameter of the circular cross section thereof and the circular cross section thereof being of sufficient diameter to accomodate the shaft of an arrow.

4. The combination according to claim 3 wherein each of the slots in said resilient material are tapered slots of a generally frustoconical configuration with the narrow end thereof on the side of said bridge member nearest said abutment member.

5. The combination according to claim 4 wherein said bridge member is a first bridge member mounted across said frame member near the other end thereof and spaced inwardly from such other end a predetermined distance; the combination further including a second bridge member mounted across said frame member intermediate said abutment member and said first bridge member and having guide means located therein in alignment with the slots in said first bridge member.

6. The combination according to claim 1 wherein said arrow quiver is adapted to be worn on the back of the user with said abutment member at the top and wherein arrows carried therein have the heads thereof adjacent said abutment member and said bridge member is located near the other end of said frame member.

7. The combination according to claim 6 wherein the slots in said bridge member are frustoconical slots having the smallest end thereof on the side nearest said abutment member, and each of said slots have elongated openings on the side of said bridge member opposite the side which is mounted to said frame member, the width of the elongated openings in the slots being less than the diameter of at least a part of the cross sections thereof.

8. The combination according to claim 7 wherein said frame member is a generally elongated U-shaped open frame member with the ends of the "U" terminating in said abutment member, the length of said frame member selected to be in excess of the longest arrow to be carried in the quiver.

9. The combination according to claim 8 wherein said abutment member further includes a resilient pad into which the heads of arrows may be pressed.

10. The combination according to claim 9 further including a cap member extending a predetermined distance toward said other end of said frame member on all sides of said abutment member and open to receive the heads of arrows carried in the quiver.

* * * * *